US008770002B2

(12) United States Patent
Takahashi

(10) Patent No.: US 8,770,002 B2
(45) Date of Patent: Jul. 8, 2014

(54) LINEAR-SPRING FORMING APPARATUS

(75) Inventor: Takehito Takahashi, Kawaguchi (JP)

(73) Assignee: Orii & Mec Corporation, Isehara-Shi, Kanagawa (JP)

( * ) Notice: Subject to any disclaimer, the term of this patent is extended or adjusted under 35 U.S.C. 154(b) by 222 days.

(21) Appl. No.: 13/395,341

(22) PCT Filed: Oct. 28, 2009

(86) PCT No.: PCT/JP2009/068487

§ 371 (c)(1),
(2), (4) Date: Mar. 9, 2012

(87) PCT Pub. No.: WO2011/052051

PCT Pub. Date: May 5, 2011

(65) Prior Publication Data

US 2012/0167652 A1 Jul. 5, 2012

(51) Int. Cl.
*B21F 35/02* (2006.01)

(52) U.S. Cl.
USPC ..... 72/137; 72/446

(58) Field of Classification Search
USPC ..... 72/135, 137, 138, 140, 145, 446
See application file for complete search history.

(56) References Cited

U.S. PATENT DOCUMENTS

| | | | | |
|---|---|---|---|---|
| 3,983,732 | A * | 10/1976 | Noyce | 72/137 |
| 5,937,685 | A * | 8/1999 | Matsuoka et al. | 72/137 |
| 2010/0050729 | A1 * | 3/2010 | Kulkarni et al. | 72/361 |

FOREIGN PATENT DOCUMENTS

| | | | |
|---|---|---|---|
| JP | 54-13087 | A | 1/1979 |
| JP | 63-83201 | U | 6/1988 |
| JP | 4-8407 | A | 1/1992 |
| JP | 10-29028 | A | 2/1998 |
| JP | 3344092 | B2 | 8/2002 |

OTHER PUBLICATIONS

International Search Report for International Application No. PCT/JP2009/068487 Dated Dec. 9, 2009.

* cited by examiner

*Primary Examiner* — Teresa M Ekiert
(74) *Attorney, Agent, or Firm* — Roberts Mlotkowski Safran & Cole P.C.

(57) ABSTRACT

An inventive linear-spring forming apparatus has: a rotatable table (10) surrounding a quill (6) for guiding a linear material; a multiplicity of slide units (15) radially arranged on, and in the circumferential direction of, the rotatable table (10) at substantially equal angular intervals, each of the slide units (15) being slidable in the radial directions of the rotatable table; and a multiplicity of slide plates (33) arranged outside, and in the circumferential direction of, the rotatable table (10) at equal angular intervals, and aligned with the respective slide units (15) in radial directions such that each slide plate (33) can be driven by a servo-motor (M3) in the radially inward and outward directions, in such a way that a selected one of the slide plates (33) advances one of the associated slide unit (15) towards the axis of the quill at a right angle thereto until the tool mounted on the slide unit abuts against the linear material (41) fed from the leading end of the quill (6) to form a linear spring. The slide plates (33) are closely and radially arranged along the circumference of the rotatable table. Every two slide plates (33) neighboring in pairs are provided with one servo-motor for selectively driving the respective slide plates one at a time.

7 Claims, 8 Drawing Sheets

(a)

(b)

(a)

(b)

(a)

(b)

(a)

(b)

LINEAR-SPRING FORMING APPARATUS

BACKGROUND OF THE INVENTION

1. Field of the Invention

This invention relates to a linear-spring forming apparatus having a multiplicity of spring forming tools radially arranged and rotatable about a quill for guiding a linear material such that a preferred spring forming tool may be positioned at a desired angle relative to the quill and advanced towards quill at a substantially right angle to the axis of the quill until the tool abuts against the linear material fed from the quill to form a linear spring.

2. Description of Related Art

A patent document 1 listed below discloses a linear-spring forming apparatus comprising: a quill for guiding a linear material; a rotatable table that is rotatable about the quill; a multiplicity of slide units that are radially arranged at equal angular intervals in the circumferential direction of the rotatable table and movable in radial directions; and a multiplicity of slide plates radially arranged outside, and in the circumferential direction of, the rotatable table at angular positions in alignment with the slide units, the slide plates being movable in radial directions when driven by a servo-motor, the apparatus characterized in that a selected one of the slide plates is advanced forward to push the slide unit associated with the slide plate at substantially right angle to the axis of the quill so as to strike the linear material fed from the leading end of the quill with a spring forming tool, thereby forming a linear-spring.

Patent Document 1 Patent No. 3344092 (JP A Laid Open H10-29028)

SUMMARY OF THE INVENTION

The linear-spring forming apparatus disclosed in Patent Document 1 has eight slide units spaced apart at equal angular intervals in the circumferential direction of the rotatable table along with eight servo-motors, also spaced apart at equal angular intervals, for driving the slide units. However, since neighboring slide plates are significantly separated from each other in the circumferential direction, it is not possible for any one of the slide units to be advanced in a radial direction if it is not aligned with a slide plate. Thus, the apparatus has many dead angles at which the linear material cannot be struck with a spring forming tool, thereby failing formation of a high precision spring.

The present inventors has been motivated to reduce such dead angles by providing a sufficient number of slide plates necessary for striking a linear material with a spring forming tool from substantially any angular direction. By increasing the number of slide plates in this manner, dead angles are mostly eliminated, allowing production of a high-precision spring. However, two new problems will then arise, as discussed below.

First, significant numbers of additional servo-motors and slide plates are further required, which invites a large cost increase of the spring forming apparatus.

Second, dead angles will not be totally eliminated so long as a finite number of spaced slide units are arranged.

To overcome the first problem, the inventors of this invention has come across a solution in which every two slide plates neighboring in pairs in the circumferential direction are provided with one servo-motor for selectively advancing the respective slide plates. This arrangement decreases the numbers of servo-motors to less than one half the number of the slide plates while decreasing dead angles.

The second problem can be solved by providing neighboring slide plates as close as possible to each other without interfering with each other in the circumferential direction. Then, by rotating the rotatable table through a predetermined angle until a preferred slide unit is aligned with one of the slide plates in position for strike the linear material, it is possible to strike the linear material with a spring forming tool from substantially any arbitrary direction, thereby substantially eliminating dead angles.

Using some trial apparatuses, this arrangement has been proved very effective in solving the problems, and is now disclosed for patent in this patent application.

In view of these observations, it is a first object of the invention to provide a linear-spring forming apparatus having an increased number of slide plates round a rotatable table with less servo-motors for driving the slide plates while decreasing dead angles for the spring forming tools for striking a linear material.

It is a second object of the invention to provide a linear-spring forming apparatus free of dead angles and capable of striking the linear material with spring forming tools from arbitrary directions around the linear material.

To achieve the first object above, there is provided in accordance with the invention as recited in either claim 1 or 2 an apparatus for forming a linear spring (the apparatus hereinafter referred to as linear-spring forming apparatus), including: a quill for guiding a linear material; a rotatable table arranged to rotate about the quill; a multiplicity of slide units radially arranged on, and in the circumferential direction of, the rotatable table at substantially equal angular intervals, each of the slide units being slidable in the radial directions of the rotatable table; a multiplicity of slide plates arranged outside, and in the circumferential direction of, the rotatable table at equal angular intervals in association with the respective slide units, each slide plate being movable in the radially inward and outward directions when driven by a servo-motor such that a selected one of the slide plates advances one of the associated slide unit towards the axis of the quill at a right angle thereto until the tool mounted on the slide unit abuts against the linear material fed from the leading end of the quill to form a linear spring, the spring forming apparatus characterized in that:

every two slide plates neighboring in pairs in the circumferential direction are provided with one servo-motor for selectively advancing and retracting the respective paired slide plates.

A rack-and-pinion mechanism or a modified Geneva power transmission mechanism driven by a servo-motor may be used as a means for selectively driving the slide plates back and forth.

As recited in claim 1, such rack-and-pinion power transmission mechanism may include: a pair of radially extending racks provided on the paired slide plates; and a semi-circular pinion mounted on the output shaft of the servo-motor arranged between the paired racks and adapted to selectively engage with the respective racks.

The modified Geneva power transmission mechanism for this purpose may be configured, as recited in claim 2, such that the servo-motor is arranged between the paired slide plates at substantially right angles with respect to the respective slide plates; and the servo-motor is provided on the output shaft thereof with a rotary disc having a pair of pins formed at the same radius from the rotational axis of the output shaft and spaced apart at equal angles in the circumferential direction of the disc; and each of the paired slide plates is provided on the rear end thereof a notch adapted to selectively engage with one of the paired pins during a forward and a backward half rotation of the output shaft.

(Function) After the rotatable table is properly rotated to rotate slide units (and hence spring forming tools) about the axis of the quill, a preferred slide plate (spring forming tool) is advanced to the quill at a substantially right angle to the axis of the quill by operating a servo-motor associated therewith, thereby strikes the linear material fed from the quill with the spring forming tool.

Since each of the slide plates neighboring in pairs in the circumferential direction can be selectively advanced by an associated servo-motor, the total number of servo-motors for this purpose is reduced to one half the number of the slide plates.

It is noted that by doubling the number of slide plates it is now possible to strike the linear material with spring forming tools from conventionally dead angles without increasing the number of servo-motors.

The linear-spring forming apparatus defined in claim 1 may be provided with: a pair of opposing racks extending on the respective paired slide plates and in the radial directions of the slide plates; and a semi-circular pinion mounted on the output shaft of the servo-motor arranged between the paired slide plates and at substantially right angles thereto, the semi-circular pinion adapted to selectively engage with the respective paired racks during a forward and a backward half rotation of the output shaft.

(Function) Each of the neighboring paired slide plates in engagement with the semi-circular pinion is selectively advanced and retracted by the pinion during a forward and a backward rotation of the output shaft.

For example, as shown in FIG. 5(*a*), when the output shaft of the servo-motor rotates in the forward direction (clockwise direction), the semi-circular pinion comes into engagement with one rack, carrying the rack (and hence the slide plate) forward (radially inward) to a predetermined position. Thereafter, as the output shaft of the servo-motor rotates in the backward direction (counterclockwise direction), the rack (slide plate) is retracted from the predetermined position to its home position, as shown in FIG. 5(*b*). Meanwhile, the semi-circular pinion does not come into engagement with the other rack. Consequently, the other rack (and the slide plate associated with the other rack) will not be moved.

On the other hand, when the output shaft of the servo-motor (or semi-circular pinion) rotates in the backward direction (counterclockwise direction) as shown in FIG. 6(*a*), and then in the forward direction (clockwise direction), the semi-circular pinion in engagement with the output shaft will carry the rack (and the slide plate) to the predetermined position, and then back to its home position. In this step, the semi-circular pinion does not come into engagement with said one rack, said one rack is not moved.

The linear-spring forming apparatus defined in claim 2 is configured such that the servo-motor is arranged between the paired racks at substantially right angles to the respective slide plates; the servo-motor is provided on the output shaft thereof with a rotary disc having a pair of pins at the same distance from the rotational axis of the disc and spaced apart through a predetermined angle in the circumferential direction of the disc; and each of the paired slide plates is provided on the rear end there of with a notch adapted to selectively engage with one of the paired pins during a forward and a backward half rotation of the output shaft.

(Function) The respective paired slide plates are selectively advanced in response to the forward and backward rotation of the output shaft of the servo-motor (rotary disc). As an example, tension coil springs are provided between each pair of the slide plates and the rotatable table for urging the paired slide plates in the radially outward direction. When the output shaft of the servo-motor (rotary disc) rotates in the forward direction (clockwise direction), one of the pins comes into engagement with the notch of one slide plate, bringing the slide plate to the predetermined position against the spring forces of the tension spring s, as shown in FIG. 7(*a*). Subsequently, as the output shaft of the servo-motor (rotary disc) rotates in the backward direction (counterclockwise direction), the slide plate is retracted by the tension spring back to its home position. In this step, the other pin does not come into engagement with the notch of the other slide plate, leaving the other slide plate immovable.

On the other hand, in the event where the output shaft of the servo-motor (rotary disc) rotates in the backward direction (counterclockwise direction) against the spring forces of the tension spring, and then in the forward direction (clockwise direction) as shown in FIG. 8, the other pin comes into engagement with the notch of the other slide plate, and push the other slide plate forward (radially inward) to a predetermined position. The other slide plate is then retracted by the tension spring back to its home position. Meanwhile, said one pin and the said one notch remain unengaged, keeping the slide plate immovable.

To overcome the second problem as discussed above, the linear-spring forming apparatus defined in claim 1 or 2 may be provided with slide plates closely arranged in the circumferential direction without interfering with each other, as defined in claim 3.

(Function) Since the slide plates are closely arranged in the circumferential direction, the apparatus has substantially no dead angle, so that the spring forming tools can strike the linear material from any direction.

In the linear-spring forming apparatus defined in claim 1 or 2, each of the slide plates may be provided on the front end thereof with an circular arc cam having a cam face whose center of curvature coincides with the axis of the quill, and each slide unit may be provided on the rear end thereof with a cam follower that abuts against the circular arc cam, as defined in claim 3.

(Function) Each of the slide units is selectively advanced as it is pushed by an associated slide plate. Without such circular arc cam, there could be friction and/or a bending moment generated between the surfaces of the slide plate and the slide unit during its advancement/retraction if the slide unit is not radially aligned with the associated slide plate, and the friction/bending moment would prevent smooth advancement/retraction of the slide unit. So long as the cam followers formed on the rear end of the slide unit remains within a allowable range of the cam face of the circular arc cam, the cam follower will roll on the cam face while it is being pushed forward (radially inward) buy the slide plate, without generating friction or bending moment between them.

Results of the Invention

The present invention can provide a linear-spring forming apparatus at a greatly reduced cost without degrading the performance of the apparatus. This is due to the fact that this apparatus requires only one half servo-motors of conventional apparatuses that require a servo-motor for every slide plate. Further, by doubling the number of the slide plates, performance of the apparatus is greatly enhanced in that dead angles of the apparatus are reduced and spring forming tools can strike a linear material from those directions not allowed in conventional apparatuses. According to claim 1, the advancement and retraction of a rack (and hence the relevant slide plate) is ensured by the rotation of a semi-circular pinion of a rack-and-pinion power transmission mechanism. This implies that the slide plates do not require springs for returning them to their home positions, and hence that the apparatus may be simplified in structure.

Although an inventive apparatus of claim 2 requires additional spring members for returning the slide plates to their home positions, in addition to modified Geneva power transmission mechanisms for advancing and retracting a slide plate, the mechanisms are simpler in structure than rack-and-pinion power transmission mechanisms, and hence cost effective.

According to claim 3, spring forming tools can be advanced to strike the linear material from any direction round the linear material (without being bothered by dead angles), so that high-precision springs can be manufactured.

According to claim 4, no friction nor no bending moment is generated on the slide plate and the slide unit in contact therewith even when they are not exactly aligned with each other, thereby facilitating smooth movement of the slide unit and ensuring long-term durability of the apparatus.

DETAILED DESCRIPTION OF THE INVENTION

The invention will now be described in detail by way of example with reference to the accompanying drawings.

Figure 1:
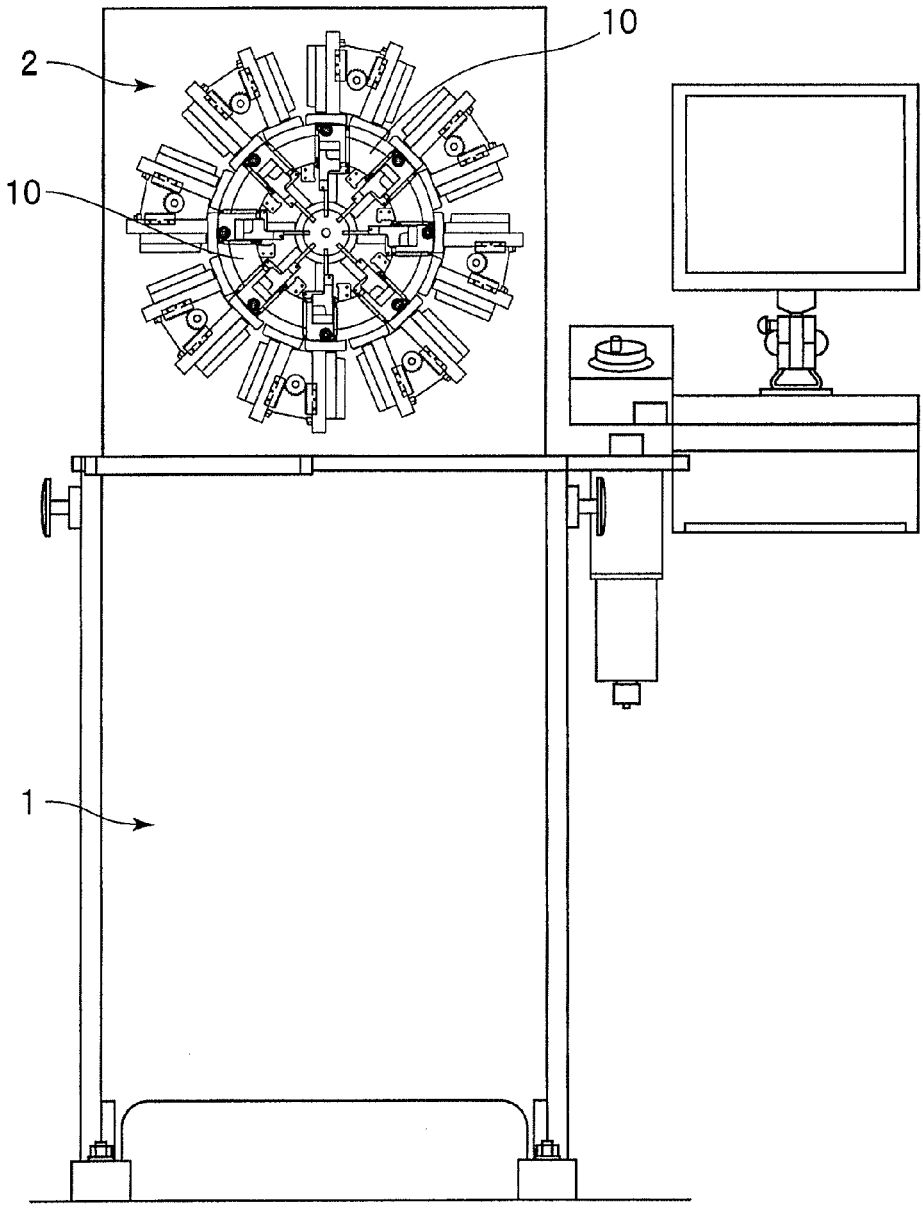
FIG. 1 is a front view of an entire linear-spring forming apparatus according to a first embodiment of the invention.
Figure 2:
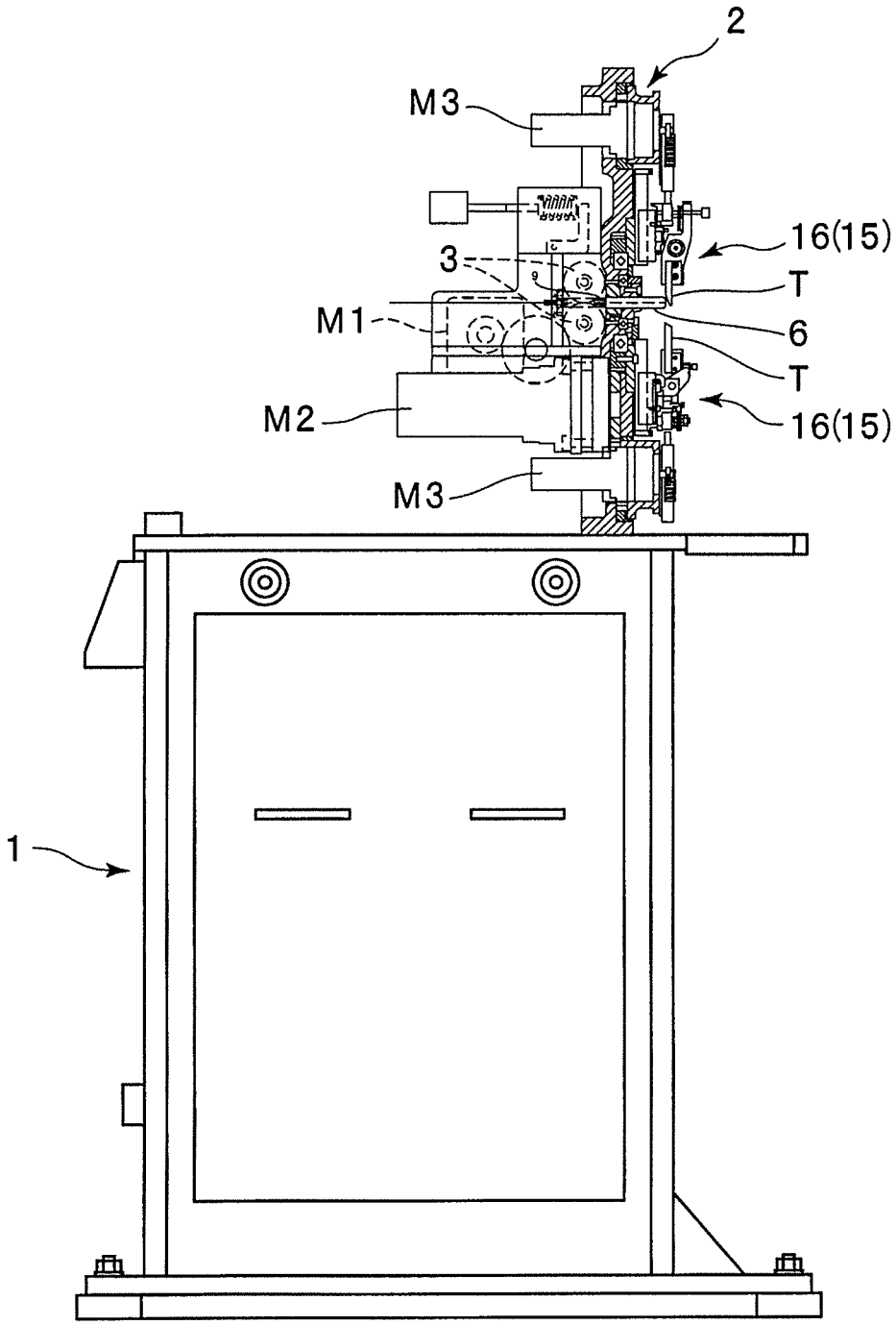
FIG. 2 is a left side view of the apparatus of FIG. 1.

Referring to FIGS. 1 and 2, there is shown a cradle 1 for supporting thereon an upper platform 2 and for housing a servo-motor M1 for driving a pair of pressure rollers, a servo-motor M2 for rotating a rotatable table 10, a servo-motor M3 for driving slide units 15 back and forth. The pressure rollers can forcibly feed a linear material 41. The cradle has a built-in multi-shaft numerical controllers 15, which is, in the example shown herein, a 10-shaft numerical controllers for controlling eight slide units 15. Mounted on the upper platform 2 are ten servo-motors and mechanical components for forming a linear spring.

Figure 3:
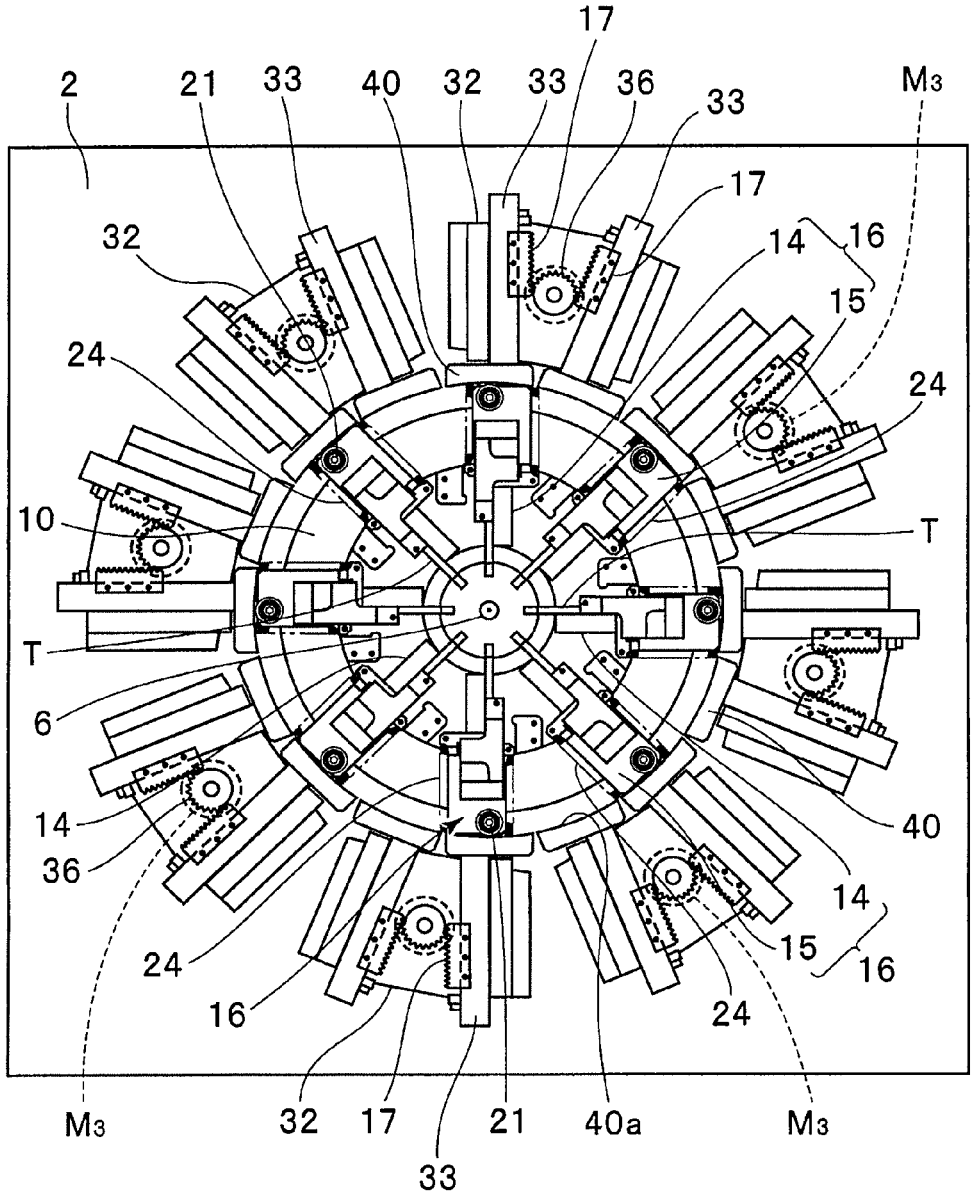
FIG. 3 is an enlarged view of an upper platform of the apparatus.

Reference numeral 3 indicates a pair of rollers for forcibly feeding a predetermined length of the linear material 41 to a quill 6. These rollers are driven by a gear train in engagement with the drive shaft 3*a* of the servo-motor M1, as shown in FIG. 3.

Figure 4:
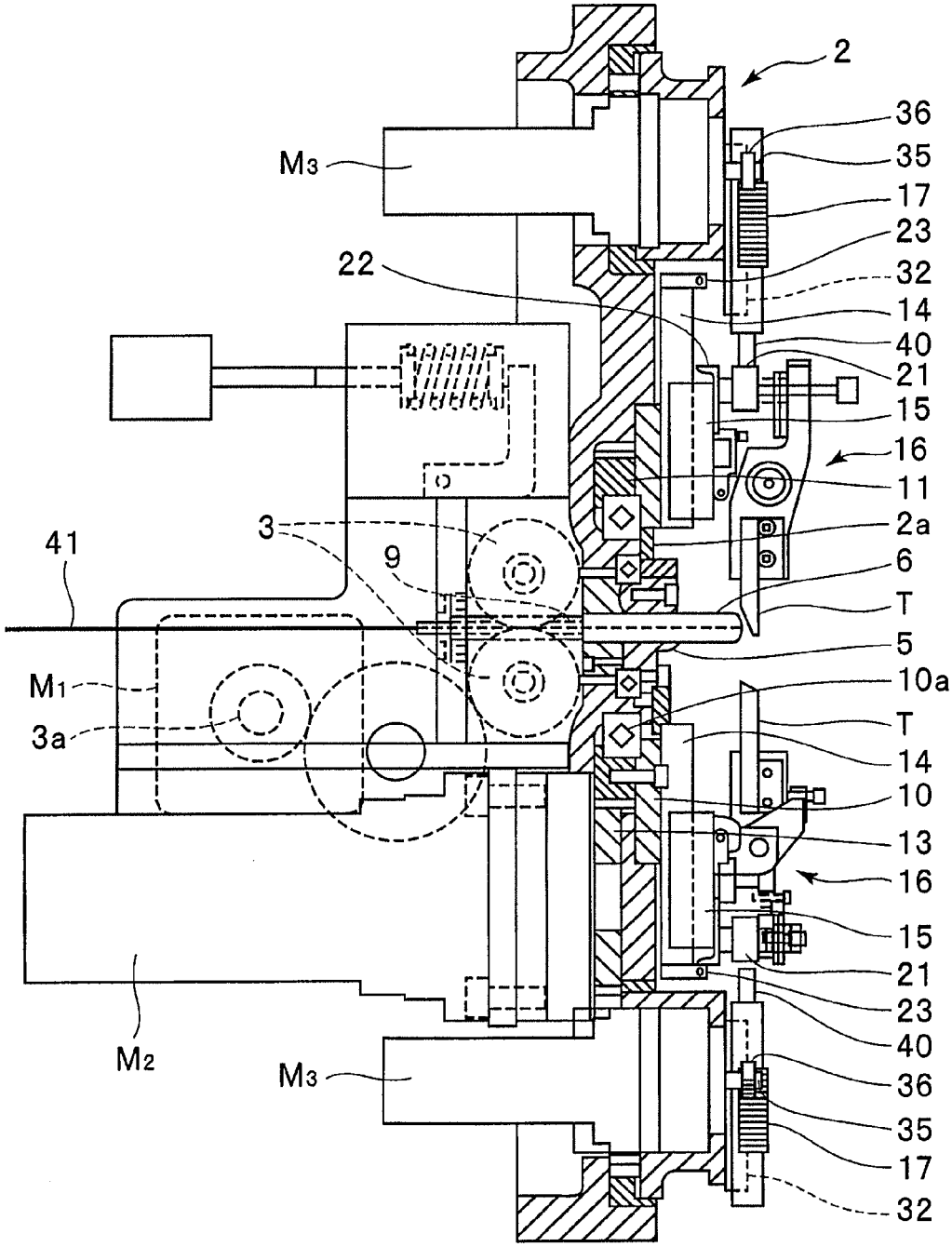
FIG. 4 is a vertical cross section of the platform, taken along Line V-V of FIG. 3.

Reference numeral 5 indicates a mandrel rotatably supported by the platform 2 via cross roller bearings. The quill 6 is removably mounted at the center of the mandrel 5, as shown in FIG. 4.

The quill 6 is rotatable about the central axis of a through-hole for passing therethrough the linear material or the axis of the mandrel, but during operation the quill is securely fixed to a bearing holding ring 2*a* that is fixed to the platform 2 not rotatably.

Reference numeral 9 indicates an intermediate quill 9 fixed to the platform 2. Via the intermediate quill 9 the linear material 41 is guided by a feed roller 3 to the quill 6 and further to the front end of the apparatus where the linear material 41 is fabricated into a linear spring.

The rotatable table 10 is supported by the platform 2 via cross roller bearings so that the table 10 is rotatable about the axis of the quill 6. To determine the predetermined angular position of the rotatable table 10, it is rotated by the output shaft of the servo-motor M2 via a ring gear 11 in engagement with a gear 13 fixed to the output shaft, as shown in FIG. 4.

Radially mounted on the rotatable table 10 are eight linear ways 16 each consisting of a track rail 14 and a slide unit 15, as shown in FIGS. 3 and 4, such that the linear ways 16 are perpendicular to the axis of the quill 6. The track rails 14 extend on the rotatable table 10 in radial directions. Each of the slide units 15 is slidable along the associated one of the track rails 14.

In what follows the end of the linear ways 16 facing the quill 6 will be referred to as the front end of the linear ways 16, the opposite end referred to as the rear end, and the movement of the slide unit 15 towards the quill 6 will be referred to as advancement, while the backward movement referred to as retraction.

Figure 5:
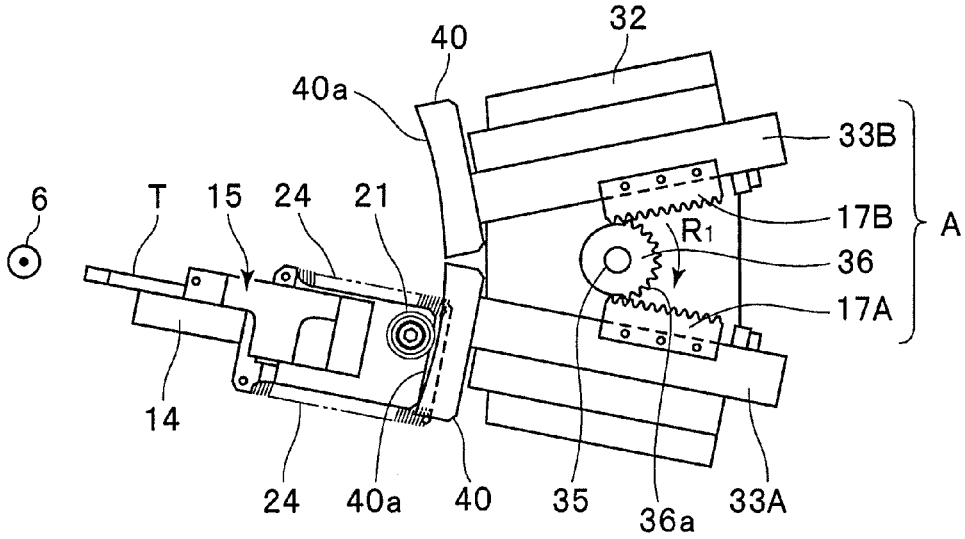
FIGS. 5(*a*) and (*b*) show a major portion of a slide plate drive mechanism (rack-and-pinion power transmission mechanism) for use with a linear-spring forming apparatus. More particularly, FIG. 5(*a*) shows a front view of the slide plate drive mechanism before advancing one of the paired slide plates, and FIG. 5(*b*) the front view after advancing the slide plate.
Figure 5:
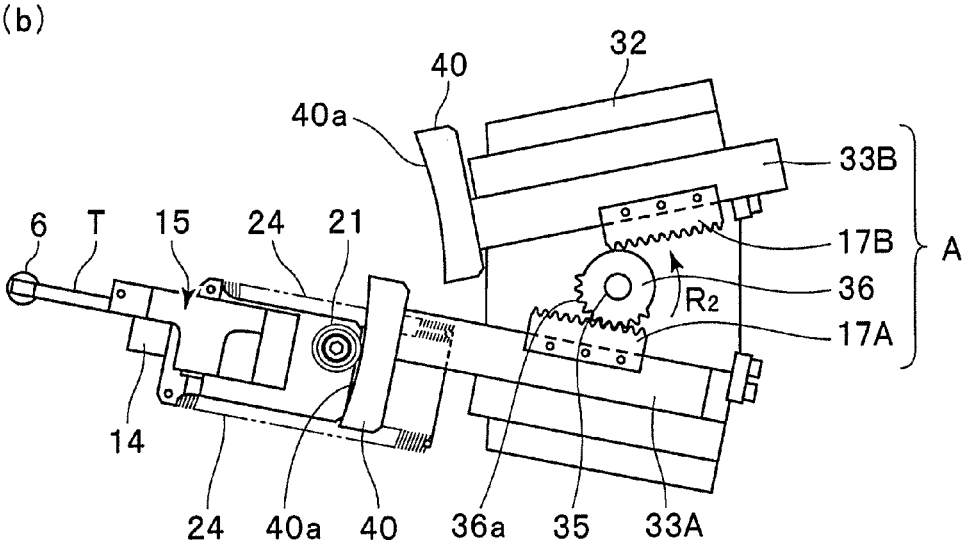

As shown in FIGS. 3 and 4, each slide unit 15 is provided on the front end thereof with a set of tools T (including for example a spring forming tool, cutting tool, linear material receiving tool, and core tool), and on the rear end thereof with a cam follower 21 adapted to abut against the cam face of a circular arc cam 40 provided on the front end of a slide plate 33 (described in detail later). There is provided between the front end of the slide unit 15 and the rear end of the track rail 14 associated therewith spring members in the form of tension coil springs 24 as shown in FIGS. 3 and 5, such that an abutment piece 22 formed on the rear end of the slide unit 15 is urged to abut against the stopper 23 formed on the track rail 14 to determine the initial position of the slide unit 15.

Figure 6:
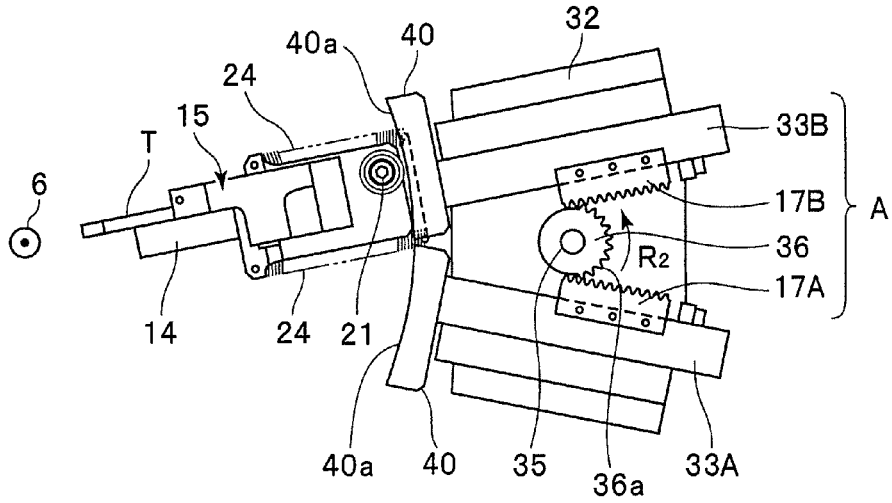
FIGS. 6(*a*) and (*b*) also show the major portion of the slide plate drive mechanism (rack-and-pinion power transmission mechanism. More particularly, FIG. 6(*a*) shows the front view of the slide plate drive mechanism before advancing the other slide plate, and FIG. 6(*b*) the front view after advancing the other slide plate.
Figure 6:
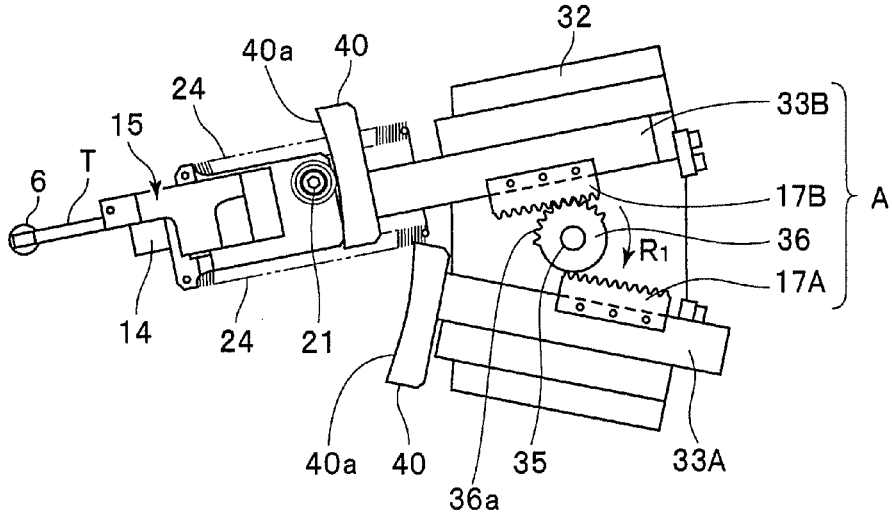

Sixteen slide plates 33 are radially arranged at equal angular intervals outside, and along the circumference of, the rotatable table 10 as shown in FIGS. 1, 3, and 4 in such a way that they can slide in their radial directions. Every two slide plates 33 neighboring in pairs in the circumferential direction are slidably guided by a slide guide 32 in radial directions. Further, two neighboring pairs of the slide plates 33 are selectively driven back and forth in the radial directions by a servo-motor M3, as shown in FIGS. 4 through 6.

Mounted on the front end of each slide plate 33 is an circular arc cam 40 having a circular cam face 40*a* facing the quill 6 as shown in FIGS. 3 and 4. The slide plate 33 (or the circular arc cam 40) can be advanced by the servo-motors M3 associated with the slide plate 33 to a normal position in front of the quill 6, where a spring forming tool T can be abutted against the linear material 41 to form a linear spring.

In this instance, the circular arc cam 40 is designed to have a partially circular cam face 40*a* such that the cam face 40*a* is coaxial with the quill when the slide unit 15 is brought to the normal position. In other words, the circular arc cam 40 is configured such that the operative position of the advanced tool T does not change so long as the circular arc cam 40 is located within a given angular range and remains in operative contact with the linear way 16.

Particularly, since the cam follower 21 is provided on the rear end of the slide unit 15 to abut against the circular arc cam 40, the cam follower 21 is pushed by the circular arc cam 40 as the slide plate 33 advances forward (radially inward), and the cam follower 21 rolls on the cam face 40*a* of the circular arc cam 40 if an angular discrepancy exists between the advancing direction of the slide plate 33 and that of the slide unit 15. As a consequence, no frictional force nor bending moment is generated between the mating faces of the slide plate 33 and the slide unit 15, thereby permitting the slide unit 15 to move smoothly in the radially inward direction.

Since the cams 39, and hence the circular arc cams 40, are closely arranged at equal angular intervals in the circumferential direction of the rotatable table without interfering with each other, tools T can be abutted against the linear material 41 from any angular direction around the rotatable table. That is, there is no operational dead angle for the tools T.

Retraction of the slide unit 15 is a reverse operation of the advancement of the slide unit 15. The retraction can be easily controlled by a multi-shaft numerical controller.

A pair of opposing radial racks 17 are provided to each pair of the slide plates 33. A semi-circular pinion 36 is provided on the output shaft 35 of the servo-motor M3 arranged between the paired racks 17 such that the pinion 36 can selectively engage with one of the paired racks during a forward and a backward half rotation of the output shaft 35.

The paired racks 17 and the output shaft 35 of the servo-motor M3 associated with one pair of slide plates 33 together constitute a rack-and-pinion power transmission mechanism A for selectively moving one of the paired slide plates back and forth.

To be specific, the rack-and-pinion power transmission mechanism consists of one pair of racks 17 fixed to the respective slide plates 33 and extending in the respective radial directions; and one semi-circular pinion 36 mounted on the output shaft 35 of a servo-motor M3 provided between the paired racks 17, the semicircular pinion 36 adapted to selectively engage with the respective racks 17 during a forward and a backward half rotation of the output shaft 35. The semi-circular pinion 36 is provided only on one half of its circumference with teeth 36*a* that can selectively engage with either one of the racks 17 during the rotation of the output shaft 35 (pinion 36) in one direction.

Referring to FIGS. 5 and 6, operation of the rack-and-pinion power transmission mechanism will now be described in detail. In this operation, the rack-and-pinion power transmission mechanism selectively advances and retracts the respective slide plates 33 in response to the associated servo-motor M3, thereby advancing and retracting the associated slide unit 15.

As shown in FIG. 5(*a*), if the output shaft 35 of the servo-motor M3 (or pinion 36) rotates in the clockwise direction R1 with the slide unit 15 aligned with one (33A or 33B) of the slide plates 33 in the radial direction, the pinion 36 comes into engagement with one (17A) of the racks 17, so that the rack 17A (and the slide plate 33A) is advanced to the predetermined position, as shown in FIG. 5(*b*). As a result, when pushed forward (radially inward) by the circular arc cam 40 of the slide plate 33, the slide unit 15 is advanced against the spring forces of the tension coil springs 24 from its initial position, where the rear end of the slide unit 15 abuts against the stopper 23, to the normal position where the spring forming tool T faces the quill 6.

When the output shaft 35 of the servo-motor M3 (or pinion 36) is rotated in the reverse direction (counterclockwise direction) R2, the advanced rack 17A (or slide plate 33A) is retracted to the home position as shown in FIG. 5(*a*). As a consequence, in association with the retraction of the slide plate 33A, the slide unit 15 is retracted to its home position (initial position) by the spring forces of the tension coil springs 24 as shown in FIG. 5(A).

Meanwhile, the other one 17B of the racks (and hence slide plate 33B) will not be moved, since the rack 17B is not in engagement with the pinion 36.

On the other hand, if the output shaft 35 of the servo-motor M3 (and hence the pinion 36) is rotated in the counterclockwise direction R2 and then in the clockwise direction R1 with the slide unit 15 located at a radial position where it comes into engagement with the other slide plate 33B as shown in FIG. 6(*a*), the pinion 36 comes into engagement with the other rack 17B, which causes the other rack 17B (hence the slide plate 33B) to be advanced to the predetermined position as shown in FIG. 6(*b*) and then retracted to the position shown in FIG. 6(*a*). In this step, the slide unit 15 is pushed forward (radially inward) by the slide plate 33 against the spring forces of the tension coil springs 24 until the tool T mounted at the leading end of the slide unit 15 comes to the reference position to face the quill 6, and then retracted back to the home position shown in FIG. 6(*b*) as the slide plate 33B retracts.

Meanwhile, the rack 17A (or slide plate 33A) are not moved, since the rack 17A does not come into engagement with the pinion 36.

Basic forward and backward movements of the slide unit 15 (or spring forming tools T) has been described above. The multi-shaft numerical controller synchronously performs: determination of the rotational position of the rotatable table (and the slide unit 15) by the servo-motor M2; advancing/retracting operation of the circular arc cam 40 (and spring forming tool T) by the servo-motor M3; and determination of the rotational position of the feed roller 3 for feeding the linear material 41 by means of servo-motor M1.

Figure 7:
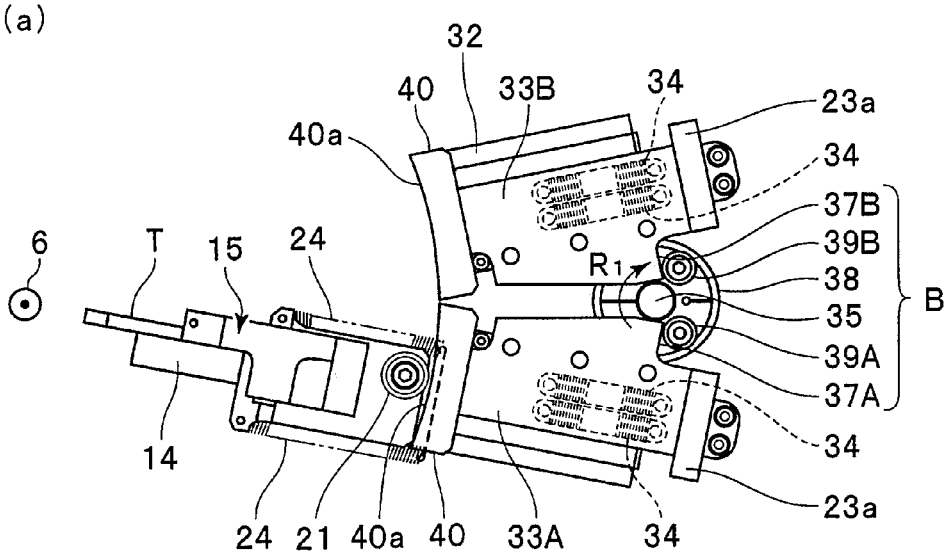
FIGS. 7(*a*) and (*b*) show a major portion of a slide plate drive mechanism (modified Geneva power transmission mechanism) for use with a linear-spring forming apparatus according to a second embodiment of the invention. More particularly, FIG. 7(*a*) shows a front view of the slide plate drive mechanism before advancing one of the slide plates, and FIG. 7(*b*) the front view after advancing one of the slide plates.
Figure 7:
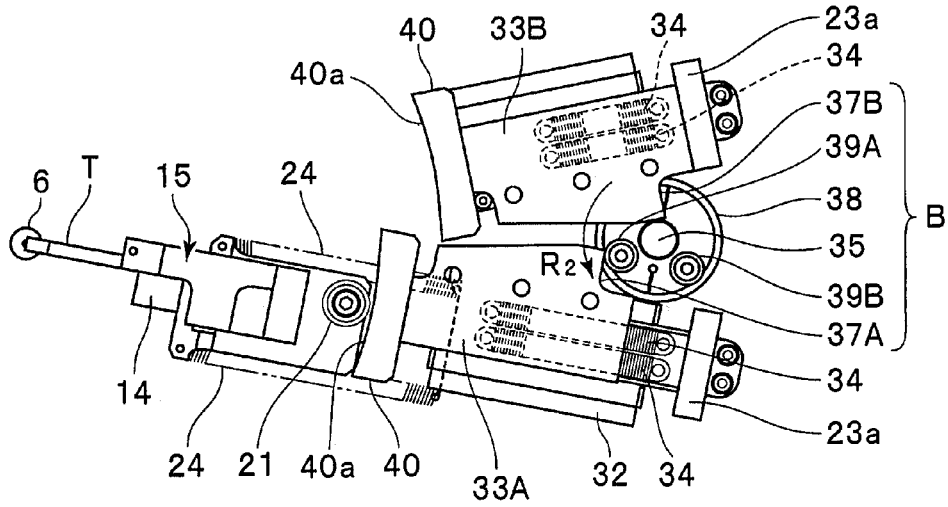
Figure 8:
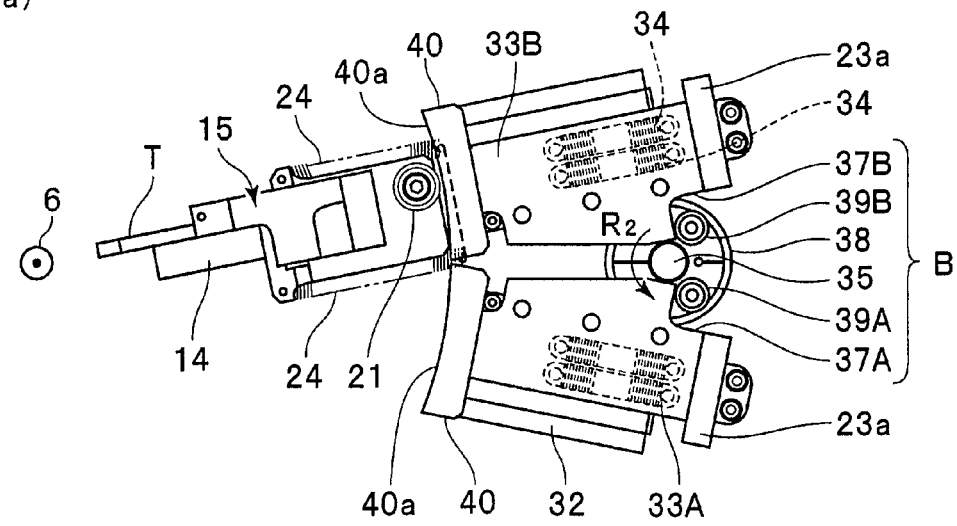
FIG. 8 also show the major portion of the slide plate drive mechanism (modified Geneva power transmission mechanism) shown in FIGS. 7(*a*) and (*b*), with FIG. 8(*a*) showing the front view of the slide plate drive mechanism before advancing the other slide plate, and FIG. 8(*b*) the front view after advancing the other slide plate.
Figure 8:
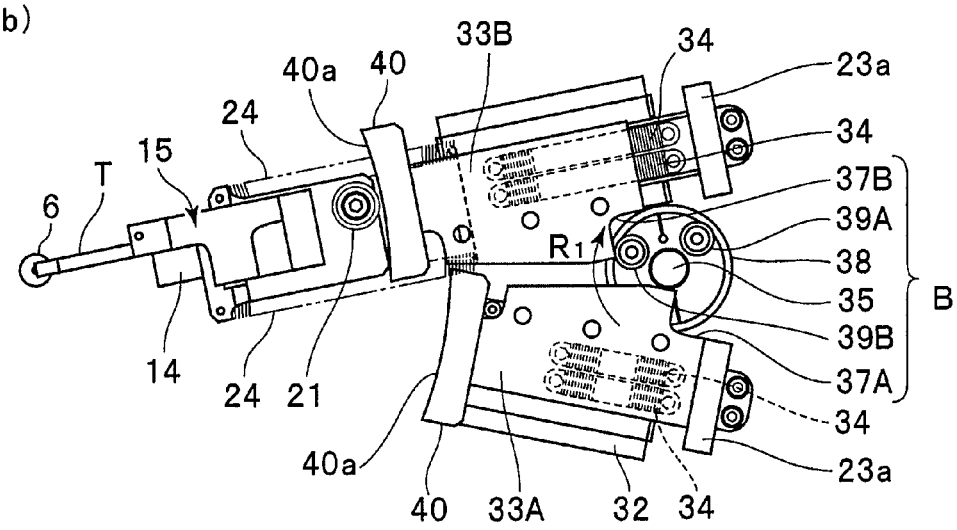

Referring to FIGS. 7 and 8, there is shown a slide plate drive mechanism in the form of a modified Geneva power transmission mechanism, which is a relevant portion of the linear-spring forming apparatus according to a second embodiment of the invention.

It is recalled that in the first embodiment above (FIGS. 1-6) the power transmission mechanism is a rack-and-pinion power transmission mechanism which consists of: a pair of racks 17 each mounted on the respective members of the paired slide plates 33 and extending in a radial direction; a servo-motor M3 mounted on the output shaft 35 of a servo-motor M3 and arranged between a pair of racks 17 arranged substantially perpendicular to the pair of slide plates 33; and a semi-circular pinion 36 that comes into selective engagement with the respective paired racks 17 during a forward and a backward half rotation of the output shaft 35 of the servo-motor M3.

In contrast, in the second embodiment, a power transmission mechanism, arranged between a pair of slide plates 33 and a servo-motor M3, is a modified Geneva power transmission mechanism B, which comprised of: a rotary disc 38 mounted on the output shaft 35 of a servo-motor M arranged between a pair of slide plates 33, the rotary disc 38 having thereon a pair of pins 39 (serving as cam followers) that are located from the same distance from the rotational axis of the disc and angularly spaced apart from each other in the circumferential direction of the disc; and a pair of notches 37 formed on the rear ends of a pair of slide plates 33 for selective engagement with the respective cam followers 39 (in the form of paired pins) during a forward and a backward half rotation of the output shaft 35 of the servo-motor M3.

More specifically, the rotary disc 38, mounted on the output shaft 35 of the servomotor M3, has the pair of pins 39 (serving as cam followers) which are not only located at the same distance from the rotational axis but also angularly spaced apart from each other by a predetermined angle. On the other hand, the pair of notches are formed on the rear ends of the paired slide plates 33 adapted to selectively engage with the respective pins 39 (cam followers) during a forward and a backward half rotation of the output shaft 35 of the servo-motor M3.

Next, referring to. FIGS. 7 and 8, operation of the Geneva power transmission mechanism B will now be described. In this operation, the Geneva power transmission mechanism B advances and retracts the slide unit 15 which is in radial alignment with a selected one of the slide plates 33 driven by the servo-motor M3.

As shown in FIGS. 7 and 8, tension coil springs 34 are provided between the paired slide plates 33 and the circumference of the upper platform 2 such that the springs urge the paired slide plates 33 towards a stopper 23*a* provided on the upper platform 2, thereby causing the rear end of the slide plates 33 to abut against the stopper 23*a*.

As shown in FIG. 7(*a*), when the slide unit 15 is located at a radial position where it is aligned with one 33A of the paired slide plates 33, the rotation of the output shaft 35 of the servo-motor M3 (and hence rotary disc 38) in the forward direction R1 (clockwise direction) brings the pin (cam follower) 39A into engagement with the notch 3A of one slide plate 33A to push the slide plate 33A in the radially forward direction as shown in FIG. 7(*b*), thereby causing the slide plate 33A to be advanced to the predetermined position against the spring forces of the tension springs 34. As a consequence, the slide unit 15 is pushed forward by the circular arc cam 40 provided at the leading end of the slide plate 33A to the normal position against the spring forces of the tension coil springs 24.

Subsequently, as the output shaft 35 of the servo-motor M3 (and hence the rotary disc 38) rotates backward (in the counterclockwise direction R2), the slide plate 33A that has been advanced forward is now retracted back to the home position shown in FIG. 7(*a*). As a result, the slide unit 15 is also retracted by the tension coil springs 24 to its home position as shown in FIG. 7(*a*).

Meanwhile, the other slide plate 33B will not be moved, since the other pin (cam follower) 39B does not come into engagement with the notch 37B of the slide plate 33B.

On the other hand, when the slide unit 15 is located at a radial position in alignment with the other slide plate 33B as shown in FIG. 8(*a*) and if the output shaft 35 of the servo-motor M3 (and hence rotary disc 38) rotates in the reverse direction (counterclockwise direction) R2 and then in the forward direction (clockwise direction) R1, the other slide plate 33B (more particularly the notch 37B) is pushed forward (radially inward direction) by the pin (cam follower) 39B and advanced to the predetermined position against the spring forces of the tension coil springs 34 and then retracted back to the home position shown in FIG. 8(*a*). In this step, the slide unit 15 pushed forward by the slide plate 33B is advanced against the spring forces of the tension coil springs 24 to the normal position where the spring forming tool T can face the quill 6, and then retracted to its home position shown in FIG. 8(*a*).

Meanwhile, the other slide plate 33A will not be moved since the other pin 39A (cam follower) does not come into engagement with the notch 37A of the other slide plate 33A.

Use of a rack-and-pinion power transmission mechanism A and of a modified Geneva power transmission mechanism B for selectively advancing and retracting a pair of slide plates 33 by a servo-motor M3 so as to advance and retract spring forming tools T of the slide units 15 have been described above in connection with the first and second embodiments. However, there can be an alternative slide unit drive mechanism for selectively advancing and retracting a pair of slide plates 33 by means of one servo-motor M3. For example, in a double-eccentric cam power transmission mechanism, a pair of coupled eccentric cams are mounted on the output shaft of a servo-motor M3 for driving cam followers coupled to the slide plates 33 such that one of the cam followers follows the motion of one eccentric cam to selectively advance and retract the respective slide plates 33.

The invention claimed is:

1. A linear-spring forming apparatus, including: a quill for guiding a linear material; a rotatable table arranged to rotate about the quill; a multiplicity of slide units radially arranged on, and in the circumferential direction of, the rotatable table at substantially equal angular intervals, each of the slide units being slidable in the radial directions of the rotatable table; a multiplicity of slide plates arranged outside, and in the circumferential direction of, the rotatable table at equal angular intervals in association with the respective slide units, each slide plate being movable in the radially inward and outward directions when driven by a servo-motor such that a selected one of the slide plates advances one of the associated slide unit towards the axis of the quill at a right angle thereto until a tool mounted on the slide unit abuts against the linear material fed from the leading end of the quill to form a linear spring, the spring forming apparatus characterized in that:

every two slide plates neighboring in pairs in the circumferential direction of the rotatable table are provided with a single servo-motor for selectively advancing and retracting the respective slide plates such that a single servo-motor selectively advances and retracts each slide plate of each neighboring pair;

said each pair of the slide plates is provided thereon with a pair of opposing racks extending in radial directions;

the servo-motor is arranged between the paired racks at substantially right angles with respect to the paired slide plates; and a semi-circular pinion adapted to selectively engage with the respective paired racks during a forward and a backward half rotation of an output shaft of the servo-motor.

2. The linear-spring forming apparatus according to claim 1, wherein the slide plates are closely arranged in the circumferential direction of the rotatable table without interfering with each other.

3. The linear-spring forming apparatus according to claim 2, wherein each slide plate is provided at the front end thereof with an circular arc cam having a cam face whose center of curvature coincides with the axis of the quill; and each slide unit is provided at the rear end thereof with a cam follower adapted to abut against the circular arc cam of the slide plate.

4. The linear-spring forming apparatus according to claim 1, wherein each slide plate is provided at the front end thereof with an circular arc cam having a cam face whose center of curvature coincides with the axis of the quill; and each slide unit is provided at the rear end thereof with a cam follower adapted to abut against the circular arc cam of the slide plate.

5. A linear-spring forming apparatus including: a quill for guiding a linear material; a rotatable table arranged to rotate about the quill; a multiplicity of slide units radially arranged on, and in the circumferential direction of, the rotatable table at substantially equal angular intervals, each of the slide units being slidable in the radial directions of the rotatable table; a multiplicity of slide plates arranged outside, and in the circumferential direction of, the rotatable table at equal angular intervals in association with the respective slide units, each slide plate being movable in the radially inward and outward directions when driven by a servo-motor such that a selected one of the slide plates advances one of the associated slide unit towards the axis of the quill at a right angle thereto until a tool mounted on the slide unit abuts against the linear material fed from the leading end of the quill to form a linear spring, the spring forming apparatus characterized in that:

every two slide plates neighboring in pairs in the circumferential direction of the rotatable table are provided with a servo-motor for selectively advancing and retracting the respective slide plates;

the servo-motor is arranged between the paired slide plates at substantially right angles with respect to the respective slide plates;

the servo-motor is provided on an output shaft thereof with a rotary disc having a pair of pins formed at the same distance from the rotational axis of the output shaft and spaced apart through a predetermined angle in the circumferential direction of the disc; and each of the paired slide plates is provided on the rear end thereof with a notch adapted to selectively engage with one of the paired pins during a forward and a backward half rotation of the output shaft.

6. The linear-spring forming apparatus according to claim 5, wherein the slide plates are closely arranged in the circumferential direction of the rotatable table without interfering with each other.

7. The linear-spring forming apparatus according to claim 5, wherein each slide plate is provided at the front end thereof with an circular arc cam having a cam face whose center of curvature coincides with the axis of the quill; and each slide unit is provided at the rear end thereof with a cam follower adapted to abut against the circular arc cam of the slide plate.

* * * * *